US008177155B2

(12) United States Patent
Sanders et al.

(10) Patent No.: US 8,177,155 B2
(45) Date of Patent: May 15, 2012

(54) APPARATUS AND METHOD FOR COMPRESSING AND WINDING OVERLAPPED FIBROUS BLANKETS

(75) Inventors: Lewis Sanders, Fayetteville, AR (US); Christopher Erbe, Farmington, AR (US)

(73) Assignee: AAF-McQuay Inc., Louisville, KY (US)

( * ) Notice: Subject to any disclaimer, the term of this patent is extended or adjusted under 35 U.S.C. 154(b) by 287 days.

(21) Appl. No.: 12/634,317

(22) Filed: Dec. 9, 2009

(65) Prior Publication Data

US 2011/0133016 A1 Jun. 9, 2011

(51) Int. Cl.
*B65H 18/14* (2006.01)

(52) U.S. Cl. ..... 242/542; 242/548; 242/541.3

(58) Field of Classification Search ..... 242/528, 242/542, 548, 541.3
See application file for complete search history.

(56) References Cited

U.S. PATENT DOCUMENTS

| | | | | |
|---|---|---|---|---|
| 402,551 | A | 4/1889 | Winn | |
| 789,707 | A | 5/1905 | Bellamy | |
| 789,786 | A | 5/1905 | Bellamy | |
| 789,787 | A | 5/1905 | Bellamy | |
| 1,051,430 | A | 1/1913 | Merritt | |
| 2,058,243 | A * | 10/1936 | Lippincott et al. | 242/528 |
| 3,546,846 | A | 12/1970 | Sens | |
| 3,813,843 | A | 6/1974 | Wooldridge et al. | |
| 3,927,504 | A | 12/1975 | Forrister | |
| 4,025,009 | A * | 5/1977 | Fineo | 242/413.7 |
| 4,085,562 | A | 4/1978 | Finn et al. | |
| 4,550,883 | A | 11/1985 | Boss | |
| 4,602,471 | A | 7/1986 | Gray et al. | |
| 4,688,368 | A | 8/1987 | Honegger | |
| 4,844,256 | A | 7/1989 | Honegger | |
| 4,896,476 | A * | 1/1990 | Harris | 53/118 |
| 5,022,523 | A | 6/1991 | Honegger | |
| 5,101,610 | A | 4/1992 | Honegger | |
| 5,425,512 | A | 6/1995 | Bichot et al. | |
| 5,832,696 | A * | 11/1998 | Nagy et al. | 53/430 |
| 6,030,496 | A | 2/2000 | Baggot et al. | |
| 6,286,419 | B1 * | 9/2001 | Wallace | 100/86 |
| 7,066,422 | B1 | 6/2006 | Slocum | |
| 7,100,862 | B2 | 9/2006 | Skarzenski et al. | |
| 7,273,193 | B2 | 9/2007 | Slocum et al. | |

FOREIGN PATENT DOCUMENTS

| | | | |
|---|---|---|---|
| JP | 2000153939 | A | 6/2000 |
| JP | 2004244158 | A | 9/2004 |
| KR | 1020090003778 | A | 1/2009 |

OTHER PUBLICATIONS

Korean Intellectual Property Office, Notification of Transmittal of the International Search Report and the Written Opinion of the International Searching Authority, or the Declaration, Search Report and Written Opinion, Aug. 2, 2011, pp. 1-9, Korean Intellectual Property Office, Republic of Korea.

* cited by examiner

*Primary Examiner* — Sang Kim
(74) *Attorney, Agent, or Firm* — Middleton Reutlinger; Scott W. Higdon; John F. Salazar

(57) ABSTRACT

In the description and drawings methods and apparatus for the compression and winding of a plurality of overlapped fibrous blankets are disclosed. The methods and apparatus may allow a leading edge of a trailing blanket to be overlapped with a trailing edge of a leading blanket that is being wound by a compressing winder assembly. As the compressing winder assembly winds the leading blanket, the trailing blanket may be moved downstream by the leading blanket and an overlapped portion of the two blankets may move through a compression zone of a winder feed chute.

20 Claims, 2 Drawing Sheets

APPARATUS AND METHOD FOR COMPRESSING AND WINDING OVERLAPPED FIBROUS BLANKETS

CROSS-REFERENCE TO RELATED DOCUMENTS

Not Applicable.

TECHNICAL FIELD

This invention is directed generally toward the accumulation of a plurality of fibrous blankets into a roll of fibrous blankets. More particularly, various inventive methods and apparatus disclosed herein pertain to the compression and winding of a plurality of overlapped fibrous blankets into a single roll of fibrous blankets.

BACKGROUND

Fiberglass filter media may be manufactured in a number of forms for supplying to an end user, such as, for example, a pad, a sheet, and a blanket. A fiberglass pad may be, for example, approximately five square feet or less in size and may be prepared for supplying to a user by stacking a plurality of pads on one another and compression packing the pads into a bag, box, or other container. A fiberglass sheet may be, for example, hundreds of feet in length and may be prepared for supplying to a user by winding the sheet into a single roll. A fiberglass blanket may be, for example, approximately three to forty feet in length. A fiberglass blanket may be used in a number of applications such as, for example, paint and/or varnish arresting. A fiberglass blanket may be prepared for supplying to a user by folding the blanket and stacking the folded blanket with a plurality of other folded blankets and compression packing and/or vacuum packing the blankets into a bag, box, or other container.

SUMMARY

The present disclosure is directed toward the accumulation of a plurality of fibrous blankets into a roll of fibrous blankets, and more specifically, to the compression and winding of a plurality of overlapped fibrous blankets into a single roll of fibrous blankets. For example, the method and apparatus may allow a leading edge of a trailing blanket to be overlapped with a trailing edge of a leading blanket that is wound by a compressing winder assembly. As the compressing winder assembly winds the leading blanket, the trailing blanket may be moved downstream by virtue of it overlapping with the leading blanket and the overlapped portion of the two blankets may move through a compression zone of a winder feed chute.

Generally, in one aspect, an apparatus for the compression and winding of a plurality of overlapped fibrous blankets into a single roll comprises a conveyor, a winder feed chute, and a compressing winder assembly. The conveyor has a downstream fibrous blanket unloading area. The winder feed chute is downstream from the conveyor and has a stationary relatively smooth upper compression surface and a stationary relatively smooth lower compression surface in spaced relation to one another. The lower compression surface and the upper compression surface define a winder feed chute entrance and a winder feed chute exit. The winder feed chute entrance is in communication with the unloading area of the conveyor. At least a portion of the spacing between the lower compression surface and the upper compression surface is sufficient to allow two overlapped fibrous blankets moving thereby to be compressed together. The compressing winder assembly is downstream from the winder feed chute and in communication with the winder feed chute exit.

In some embodiments the compressing winder assembly includes at least one upper roller and at least one lower roller. In versions of these embodiments the compressing winder assembly includes a mandrel flanked by the at least one upper roller and the at least one lower roller.

In some embodiments the lower compression surface and the upper compression surface are spaced apart moreso proximal the winder feed chute entrance than proximal the winder feed chute exit.

In some embodiments a staging area is interposed between the fibrous blanket unloading area and the winder feed chute entrance. In versions of these embodiments the staging area has a stationary staging area bottom surface. Optionally, the stationary staging area bottom surface is substantially in line with the fibrous blanket unloading area and the lower compression surface of the winder feed chute.

In some embodiments the lower compression surface and the upper compression surface are parallel one another during at least the portion of the spacing therebetween that is sufficient to allow two overlapped fibrous blankets moving thereby to be compressed together.

Generally, in another aspect, an apparatus for the compression and winding of a plurality of overlapped fibrous blankets into a single roll comprises a staging area, a winder feed chute, and a compressing winder assembly. The staging area has a stationary staging area bottom surface. The winder feed chute is downstream from the staging area and has a stationary relatively smooth upper compression surface and a stationary relatively smooth lower compression surface in spaced relation to one another. The lower compression surface and the upper compression surface define a winder feed chute entrance and a winder feed chute exit. The winder feed chute entrance is in communication with the stationary staging area bottom surface. At least a portion of the spacing between the lower compression surface and the upper compression surface is sufficient to allow two overlapped fibrous blankets moving thereby to be compressed together. The compressing winder assembly is downstream from the winder feed chute and in communication with the winder feed chute exit.

In some embodiments the lower compression surface and the upper compression surface are spaced apart moreso proximal the winder feed chute entrance than proximal the winder feed chute exit.

In some embodiments the stationary staging area bottom surface is substantially in line with the lower compression surface of the winder feed chute.

In some embodiments the stationary staging area has sidewalls extending upwardly from the stationary staging area bottom surface, each of the sidewalls substantially in line with one side of the winder feed chute entrance.

Generally, in another aspect, a method of compressing and winding a plurality of similarly sized fibrous blankets into a single roll comprises feeding a plurality of fibrous blankets onto a conveyor moving downstream toward a winder feed chute having a stationary winder feed chute compression zone. The method further comprises allowing a leading portion of a first blanket of the plurality of fibrous blankets to pass from the conveyor, through the winder feed chute, and engage a compressing winder assembly located downstream of the winder feed chute. When the first blanket engages the compressing winder assembly, the compressing winder assembly begins to wind the first blanket and thereby pulls a trailing portion of the first blanket downstream. The method further comprises overlapping a leading portion of a second blanket of the plurality of fibrous blankets with the trailing portion of the first blanket prior to the trailing portion of the first blanket entering the winder feed chute compression zone. The method further comprises allowing the leading portion of the second blanket to be pulled through the winder feed chute by the first blanket and engage the compressing winder assembly. When the second blanket engages the compressing winder assembly, the compressing winder assembly begins to wind the second blanket and thereby pulls a trailing portion of the second blanket downstream. The method further comprises overlapping a leading portion of a third blanket of the plurality of fibrous blankets with a trailing portion of the second blanket prior to the trailing portion of the second blanket entering the winder feed chute compression zone. When the third blanket engages the compressing winder assembly, the compressing winder assembly begins to wind the third blanket and thereby pulls a trailing portion of the third blanket downstream.

In some embodiments the first blanket, the second blanket, and the third blanket are elongated blankets each having an elongated length extending from the leading portion thereof to the trailing portion thereof, and the amount of overlap between the second blanket and the first blanket and the amount of overlap between the second blanket and the third blanket is less than one fourth of the elongated length of any of the first blanket, the second blanket, or the third blanket.

In some embodiments the amount of overlap between the second blanket and the first blanket and the amount of overlap between the third blanket and the second blanket is less than one tenth of the elongated length of any of the first blanket, the second blanket, or the third blanket.

In some embodiments the first blanket, the second blanket, and the third blanket are elongated blankets each having an elongated length extending from the leading portion thereof to the trailing portion thereof, and the amount of overlap between the second blanket and the first blanket and the amount of overlap between the second blanket and the third blanket is at least approximately half the circumference of the single roll and less than the circumference of the single roll.

In some embodiments the winder feed chute compression zone has a relatively smooth stationary upper compression surface and a relatively smooth stationary lower compression surface in spaced relation to one another. In versions of these embodiments the lower compression surface and the upper compression surface are in a tapered spaced relation to one another.

In some embodiments a staging area is interposed between the conveyor and the winder feed chute. In versions of these embodiments the staging area has a stationary staging area bottom surface substantially in line with the lower compression surface.

In some embodiments the leading portion of the second blanket is overlapped atop the trailing portion of the first blanket. In some embodiments the trailing portion of the first blanket is overlapped atop the leading portion of the second blanket.

Generally, in another aspect, a method of compressing and winding a plurality of similarly sized fibrous blankets into a single roll comprises delivering a plurality of fibrous blankets to a staging area adjacent a winder feed chute having a stationary relatively smooth stationary upper compression surface and a stationary relatively smooth stationary lower compression surface in spaced relation to one another. The upper compression surface and the lower compression surface define a feed chute compression zone. The method further comprises allowing a leading portion of a first blanket of the plurality of fibrous blankets to pass from the staging area, through the winder feed chute, and engage a compressing winder assembly located downstream of the winder feed chute. When the first blanket engages the compressing winder assembly, the compressing winder assembly begins to wind the first blanket and thereby pulls a trailing portion of the first blanket downstream. The method further comprises overlapping a leading portion of a second blanket of the plurality of fibrous blankets with the trailing portion of the first blanket prior to the trailing portion of the first blanket entering the winder feed chute compression zone. The method further comprises allowing the leading portion of the second blanket to be pulled through the winder feed chute by the first blanket and engage the compressing winder assembly. When the second blanket engages the compressing winder assembly, the compressing winder assembly begins to wind the second blanket and thereby pulls a trailing portion of the second blanket downstream. The method further comprises overlapping a leading portion of a third blanket of the plurality of fibrous blankets with a trailing portion of the second blanket prior to the trailing portion of the second blanket entering the winder feed chute compression zone. When the third blanket engages the compressing winder assembly, the compressing winder assembly begins to wind the third blanket and thereby pulls a trailing portion of the third blanket downstream.

BRIEF DESCRIPTION OF THE ILLUSTRATIONS

In the drawings, like reference characters generally refer to the same parts throughout the different views. Also, the drawings are not necessarily to scale, emphasis instead generally being placed upon illustrating the principles of the invention.

DETAILED DESCRIPTION

Figure 1:
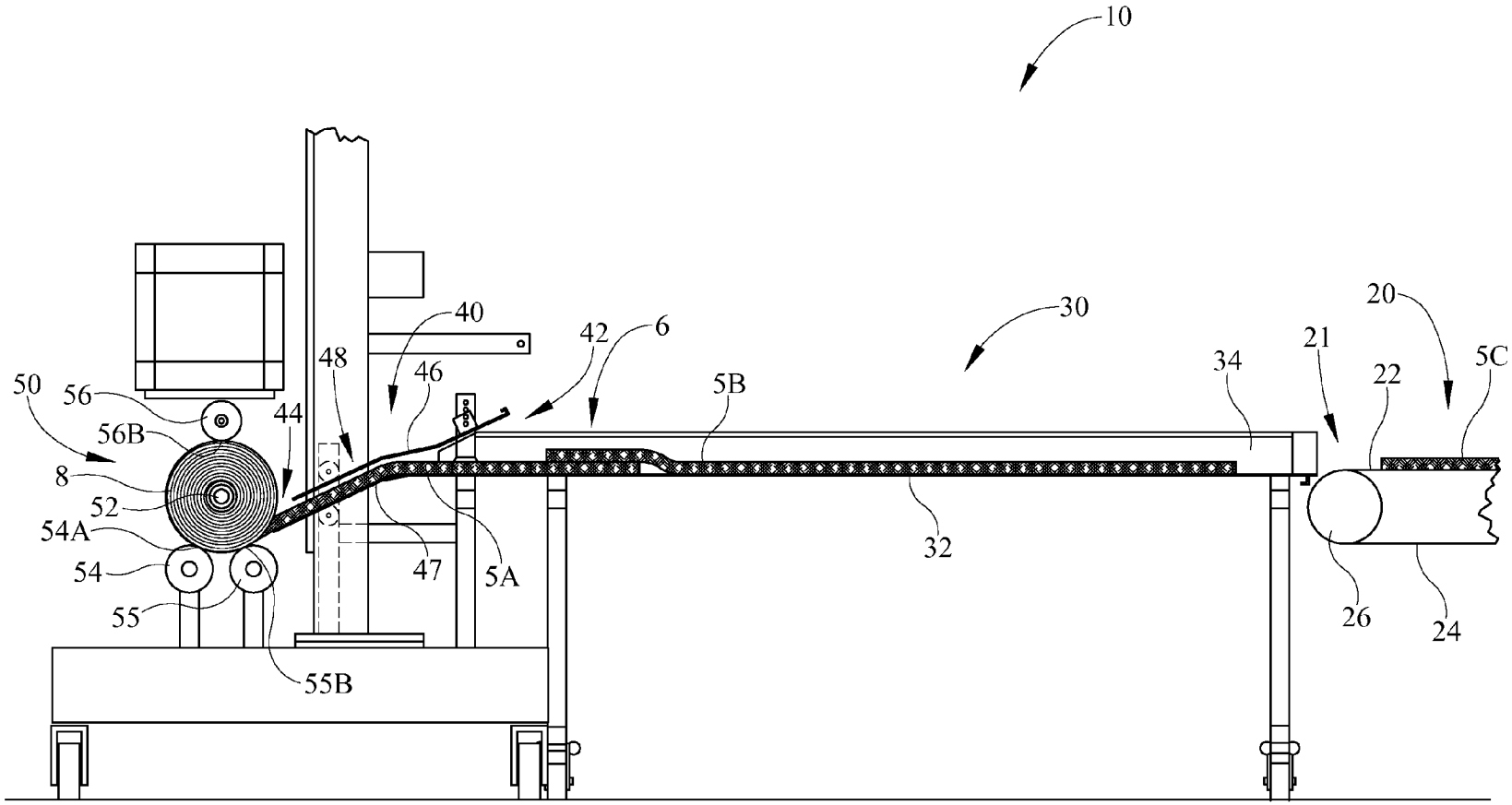
FIG. 1 is a side sectional view of an embodiment of an apparatus for compressing and winding a plurality of overlapped fibrous blankets, showing three fibrous blankets in a first position.

It is to be understood that the invention is not limited in its application to the details of construction and the arrangement of components set forth in the following description or illustrated in the drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless limited otherwise, the terms "connected," "coupled," "in communication with" and "mounted," and variations thereof herein are used broadly and encompass direct and indirect connections, couplings, and mountings. In addition, the terms "connected" and "coupled" and variations thereof are not restricted to physical or mechanical connections or couplings.

Furthermore, and as described in subsequent paragraphs, the specific mechanical configurations illustrated in the drawings are intended to exemplify embodiments of the invention and that other alternative mechanical configurations are possible.

Figure 2:
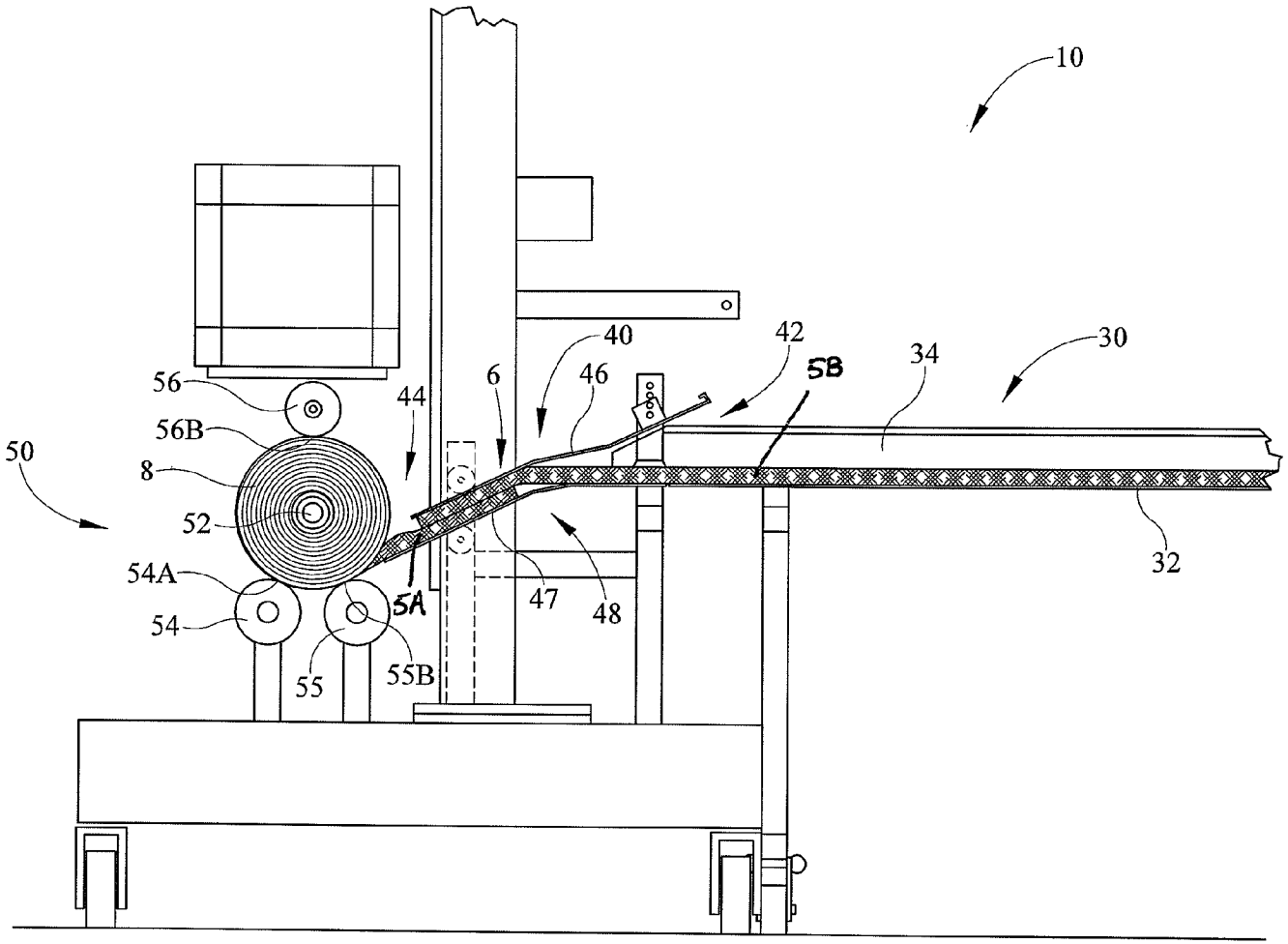
FIG. 2 is a close up side sectional view of the apparatus for compressing and winding a plurality of overlapped fibrous blankets of FIG. 1, showing two of the three fibrous blankets of FIG. 1 later in time in a second position.

Referring now to FIG. 1 and FIG. 2, various embodiments of methods and apparatus for the compression and winding of a plurality of overlapped fibrous blankets into a roll of fibrous blankets will be described in detail. Referring initially to FIG. 1, an embodiment of an apparatus 10 for the compression and winding of a plurality of overlapped fibrous blankets into a single roll includes an endless conveyor 20. The endless conveyor 20 has a fibrous blanket unloading area 21 adjacent, in communication with, and upstream from a staging area 30. The depicted endless conveyor 20 rotates about a pulley 26 and has a conveyor forward run 22 and a conveyer rearward run 24. A leading end of a fibrous mat 5C is visible atop the conveyor 20 and is moving in a downstream direction on the conveyor forward run 22 toward the staging area 30. The trailing end of the fibrous mat 5C may be provided on the conveyor 20 upstream of the leading end or may still be in process upstream. One or more additional fibrous mats may also be provided upstream of the fibrous mat 5C on conveyor 20 or one or more additional conveyors, as desired.

The staging area 30 is provided downstream of the conveyor 20 and is positioned to receive fibrous mats unloaded from the fibrous blanket unloading area 21 of the endless conveyor 20. The staging area 30 is upstream from a winder feed chute 40 and is in communication with the winder feed chute 40. The staging area 30 area has a stationary staging area bottom surface 32 substantially in line with the conveyor forward run 22 and also substantially in line with a portion of a relatively smooth lower compression surface 47 of the winder feed chute 40. In the depicted embodiment the staging area bottom surface 32 and the lower compression surface 47 are formed from two different parts. In alternative embodiments the staging area bottom surface 32 and the lower compression surface 47 may be integrally formed with one another. The staging area 30 also has a staging area sidewall 34 on each lateral side thereof extending upwardly from the staging area bottom surface 32 and in a direction generally parallel with the movement of the fibrous mat 5C on conveyor 20. Only one staging area sidewall 34 is visible in FIG. 1 and FIG. 2 since a section view of the apparatus 10 is shown. In some embodiments some or all of the staging area 30 may be manufactured from a relatively rigid and smooth material, such as, for example, polished stainless steel or sheet metal. In some embodiments the distance between opposed staging area sidewalls 34 may be similar to the width of a fibrous mat and/or may be similar to the width of the winder feed chute 40. In some embodiments the sidewalls 34 may act as a jig in aligning fibrous mat 5*b* as it approaches the chute 40, thereby assisting to square the overlap between fibrous mat 5*a* and fibrous mat 5*b*.

A fibrous mat 5B is depicted on the staging area 30, with a majority of the fibrous mat 5B atop the staging area bottom surface 32. The leading edge of the fibrous mat 5B is shown atop a trailing edge of a fibrous mat 5A, thereby forming a mat overlap portion 6. In alternative embodiments the trailing edge of the fibrous mat 5A may be atop the leading edge of the fibrous mat 5B to thereby form a mat overlap portion 6. In some embodiments one or both of the mats 5A and 5B may be manually adjusted by an operator to create the overlap portion 6. In other embodiments one or more device may be additionally or alternatively used to create the overlap portion 6. For example, in some embodiments the apparatus 10 may employ a variable speed conveyor 20 in combination with an inclined ramp interposed between the conveyor 20 and the staging area 30. The speed of the conveyor 20 may be selectively varied in order to overlap a leading edge of a trailing fibrous mat atop a trailing edge of a leading fibrous mat.

In some embodiments the staging area 30 may be omitted. For example, in some embodiments the endless conveyor 20 may be provided immediately adjacent to and directly feed the winder feed chute 40. In those embodiments, for example, a user or one or more device may be used to create an overlap portion 6 before or proximal to the time a trailing edge of a leading fibrous mat enters the winding feed chute 40. In some embodiments the endless conveyor 20 may be omitted. For example, in some embodiments fibrous mats may be otherwise provided to staging area 30. In those embodiments, for example, fibrous mats may be manually provided to staging area 30 or a declined ramp may provide fibrous mats to the staging area.

The winder feed chute 40 is provided downstream of the staging area 30 and the conveyor 20 and has a winder feed chute entrance 42 and a winder feed chute exit 44. The winder feed chute entrance 42 is positioned to receive fibrous mats from the staging area 30. The winder feed chute exit 44 is proximal a compressing winder assembly 50 and positioned to allow fibrous mats exiting therefrom to be fed to the compressing winder assembly 50. The winder feed chute 40 has a stationary relatively smooth upper compression surface 46 in spaced relation to the stationary relatively smooth lower compression surface 47 and they collectively help define the winder feed chute entrance 42 and the winder feed chute exit 44. In the depicted embodiment the upstream end of the upper compression surface 46 flares upwardly at an angle and extends more upstream than the upstream end of the lower compression surface 47. In the depicted embodiment the downstream end of the lower compression surface 47 extends more downstream than the downstream end of the upper compression surface 46. The winder feed chute 40 may optionally have winder feed chute sidewalls extending between a portion or all of the upper compression surface 46 and the lower compression surface 47.

The upper compression surface 46 and the lower compression surface 47 are tapered and spaced apart from one another moreso proximal the winder feed chute entrance 42 then at the winder feed chute exit 44. A portion of the spacing between the lower compression surface 47 and the upper compression surface 46 is such that it forms a compression zone 48 that allows two overlapped fibrous blankets moving therethrough to be compressed together. The overlapped fibrous blankets moving through the compression zone 48 are compressed enough to create sufficient friction between the overlapped portions thereof to maintain the overlapped portions of the fibrous blankets in position as they are pulled through the winder feed chute 40 by compressing winder assembly 50. The spacing of the compression zone 48 may be configured for fibrous mats having a predetermined range of uncompressed thickness. In some embodiments the spacing of the compression zone 48 may be adjustable to accommodate fibrous mats of a wider range of uncompressed thicknesses.

The compressing winder assembly 50 is provided downstream of the winder feed chute 40, the staging area 30 and the conveyor 20. The compressing winder assembly 50 includes a mandrel 52 that is flanked by a pair of bottom rollers 54 and 55 and an upper roller 56. The mandrel 52 is depicted with a roll 8 of a plurality of fiberglass mats wrapped therearound. An upper roller pinch point 56*b* is present where the upper roller 56 contacts the roll 8 and lower roller pinch points 54*a* and 55*a* are present where the lower rollers 54 and 55 contact the roll 8. The compressing winder assembly 50 is configured to wind fibrous mats and additionally compress the fibrous mats as they are being wound.

Alternative compressing winder assemblies that are configured to wind fibrous mats and additionally compress the fibrous mats as they are being wound may be implemented into the apparatus 10 as understood by those skilled in the art. For example, many assemblies exist for compressing and winding fibrous sheets and may be adapted for implementation into apparatus 10. Such assemblies include, for example, those implementing additional and/or alternatively placed rollers in combination with a mandrel, those utilizing Kraft paper or other medium to compress and wind fibrous sheets therebetween, and those utilizing one or more rollers in combination with one or more conveyor belts.

With continuing reference to FIG. 1 a method of compressing and winding a plurality of fibrous blankets into a single roll is described in additional detail. Prior to entering the winder feed chute 40, the leading portion of the trailing blanket 5B is pulled forward to overlap the trailing portion of the leading blanket 5A immediately in front of it, thereby forming the overlap portion 6. In some embodiments the overlap portion may be approximately eighteen inches and both the leading blanket 5A and the trailing blanket 5B may be elongated blankets approximately thirty feet in length (in the direction of the movement of the blankets on the apparatus 10) and approximately seven and a half feet wide (transverse to the direction of the movement of the blankets on the apparatus 10). The leading portion of the leading blanket 5A is being wound in the compressing winder assembly 50. The trailing blanket 5B is overlapped on top of the leading blanket 5A. The leading blanket 5A pulls the trailing blanket 5B upstream as a result of the leading blanket 5A being wound and pulled upstream by the compressing winder assembly 50.

With reference to FIG. 2, a close up side sectional view of the apparatus 10 of FIG. 1 is shown later in time, with the leading blanket 5A and the trailing blanket 5B shown in a second position. The overlapped portion 6 of the leading blanket 5A and the trailing blanket 5B is moving through the compression zone 48 of the winder feed chute 40. The leading blanket 5A and the trailing blanket 5B are compressed together in compression zone 48 enough to create sufficient friction between the overlapped portions thereof to maintain the overlapped portions thereof substantially in position as the fibrous blankets 5A and 5C are pulled the rest of the way through the winder feed chute 40 and are wound about the mandrel 52 to form a part of the roll 8.

In some embodiments the amount that the leading portion of the trailing blanket 5B overlaps the trailing portion of the leading blanket 5A may be based on the size of the final finished roll 8. For example, the amount of overlap may be based on the distance between the pinch point 54*a* and the pinch point 56*b* along the outer circumference of the final finished roll 8. Making the amount of overlap at least equal to the distance between the pinch point 54*a* and the pinch point 56*b* along the outer circumference of the final finished roll 8 may ensure the leading edge of the trailing blanket 5B makes it to the top pinch point 56*a* before the trailing edge of the leading blanket 5A exits the bottom roller pinch point 56*b*, thereby reducing the likelihood of the trailing edge of fibrous blanket 5A becoming separated from the leading edge of blanket 5B. For example, in some embodiments the diameter of the finished roll may be approximately forty inches and approximately eighteen inches of overlap may be utilized.

Once the roll 8 reaches a desired diameter it may be removed from mandrel 52 and prepared for supplying to a customer. For example, the roll 8 may be removed from the mandrel 52 and one or more straps or belts may be placed around the circumference thereof. Also, for example, the roll 8 may be removed from the mandrel 52 and placed in a box or other container. Optionally, a roll or core may be provided interposed between the mandrel 52 and the roll 8. In some embodiments the final finished roll may provide for user friendly dispensing of wound blankets, allowing a user to dispense a single blanket at a time while maintaining the remainder of the blankets in a compressed state.

In some embodiments the apparatus and method described herein may increase compression on the order of thirty-two fold. In some embodiments the apparatus and method described herein may eliminate creases caused by other packaging methods and eliminate the need to unfold and straighten the blanket prior to use.

While several inventive embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the inventive embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the inventive teachings is/are used. Those skilled in the art will recognize, or be able to ascertain using no more than routine experimentation, many equivalents to the specific inventive embodiments described herein. It is, therefore, to be understood that the foregoing embodiments are presented by way of example only and that, within the scope of the appended claims and equivalents thereto, inventive embodiments may be practiced otherwise than as specifically described and claimed. Inventive embodiments of the present disclosure are directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the inventive scope of the present disclosure.

The indefinite articles "a" and "an," as used herein in the specification and in the claims, unless clearly indicated to the contrary, should be understood to mean "at least one."

The phrase "and/or," as used herein in the specification and in the claims, should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc.

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of" "Consisting essentially of," when used in the claims, shall have its ordinary meaning as used in the field of patent law.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

It should also be understood that, unless clearly indicated to the contrary, in any methods claimed herein that include more than one step or act, the order of the steps or acts of the method is not necessarily limited to the order in which the steps or acts of the method are recited.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively, as set forth in the United States Patent Office Manual of Patent Examining Procedures, Section 2111.03.

We claim:

1. An apparatus for the compression and winding of a plurality of overlapped fibrous blankets into a single roll, the apparatus comprising:

a conveyor having a downstream fibrous blanket unloading area;

a winder feed chute downstream from said conveyor, said winder feed chute having a stationary relatively smooth upper compression surface and a stationary relatively smooth lower compression surface in spaced relation to one another; said lower compression surface and said upper compression surface defining a winder feed chute entrance and a winder feed chute exit;

wherein said winder feed chute entrance is in communication with said unloading area of said conveyor;

wherein at least a portion of the spacing between said lower compression surface and said upper compression surface is sufficient to allow two overlapped fibrous blankets moving thereby to be compressed together;

a compressing winder assembly downstream from said winder feed chute and in communication with said winder feed chute exit.

2. The apparatus of claim 1 wherein said compressing winder assembly includes at least one upper roller and at least one lower roller.

3. The apparatus of claim 2 wherein said compressing winder assembly includes a mandrel flanked by said at least one upper roller and said at least one lower roller.

4. The apparatus of claim 1 wherein said lower compression surface and said upper compression surface are spaced apart more proximal said winder feed chute entrance than proximal said winder feed chute exit.

5. The apparatus of claim 1 further comprising a staging area interposed between said fibrous blanket unloading area and said winder feed chute entrance.

6. The apparatus of claim 5 wherein said staging area has a stationary staging area bottom surface.

7. The apparatus of claim 6 wherein said stationary staging area bottom surface is substantially in line with said fibrous blanket unloading area and said lower compression surface of said winder feed chute.

8. An apparatus for the compression and winding of a plurality of overlapped fibrous blankets into a single roll, the apparatus comprising:

a staging area having a stationary staging area bottom surface;

a winder feed chute downstream from said staging area, said winder feed chute having a stationary relatively smooth upper compression surface and a stationary relatively smooth lower compression surface in spaced relation to one another; said lower compression surface and said upper compression surface defining a winder feed chute entrance and a winder feed chute exit;

wherein said winder feed chute entrance is in communication with said stationary staging area bottom surface;

wherein at least a portion of the spacing between said lower compression surface and said upper compression surface is sufficient to allow two overlapped fibrous blankets moving thereby to be compressed together;

a compressing winder assembly downstream from said winder feed chute and in communication with said winder feed chute exit.

9. The apparatus of claim 8 wherein said lower compression surface and said upper compression surface are spaced apart more proximal said winder feed chute entrance than proximal said winder feed chute exit.

10. The apparatus of claim 8 wherein said stationary staging area bottom surface is substantially in line with said lower compression surface of said winder feed chute.

11. The apparatus of claim 8 wherein said stationary staging area has sidewalls extending upwardly from said stationary staging area bottom surface, each of said sidewalls substantially in line with one side of said winder feed chute entrance.

12. A method of compressing and winding a plurality of similarly sized fibrous blankets into a single roll, the method comprising the steps of:

feeding a plurality of fibrous blankets onto a conveyor moving downstream toward a winder feed chute having a stationary winder feed chute compression zone;

allowing a leading portion of a first blanket of said plurality of fibrous blankets to pass from said conveyor, through said winder feed chute, and engage a compressing winder assembly located downstream of said winder feed chute;

wherein when said first blanket engages said compressing winder assembly, said compressing winder assembly begins to wind said first blanket and thereby pulls a trailing portion of said first blanket downstream;

overlapping a leading portion of a second blanket of said plurality of fibrous blankets with said trailing portion of said first blanket prior to said trailing portion of said first blanket entering said winder feed chute compression zone;

allowing said leading portion of said second blanket to be pulled through said winder feed chute by said first blanket and engage said compressing winder assembly;

wherein when said second blanket engages said compressing winder assembly, said compressing winder assembly begins to wind said second blanket and thereby pulls a trailing portion of said second blanket downstream;

overlapping a leading portion of a third blanket of said plurality of fibrous blankets with a trailing portion of said second blanket prior to said trailing portion of said second blanket entering said winder feed chute compression zone;

wherein when said third blanket engages said compressing winder assembly, said compressing winder assembly begins to wind said third blanket and thereby pulls a trailing portion of said third blanket downstream.

13. The method of claim 12 wherein said first blanket, said second blanket, and said third blanket are elongated blankets each having an elongated length extending from said leading portion thereof to said trailing portion thereof, and wherein the amount of overlap between said second blanket and said first blanket and the amount of overlap between said third blanket and said second blanket is less than one fourth of said elongated length of any of said first blanket, said second blanket, or said third blanket.

14. The method of claim 12 wherein said first blanket, said second blanket, and said third blanket are elongated blankets each having an elongated length extending from said leading portion thereof to said trailing portion thereof, and wherein the amount of overlap between said second blanket and said first blanket and the amount of overlap between said third blanket and said second blanket is less than one tenth of said elongated length of any of said first blanket, said second blanket, or said third blanket.

15. The method of claim 12 wherein said winder feed chute compression zone has a relatively smooth stationary upper compression surface and a relatively smooth stationary lower compression surface in spaced relation to one another.

16. The method of claim 15, wherein said lower compression surface and said upper compression surface are in a tapered spaced relation to one another.

17. The method of claim 12, wherein a staging area is interposed between said conveyor and said winder feed chute.

18. The method of claim 17, wherein said staging area has a stationary staging area bottom surface substantially in line with said lower compression surface.

19. The method of claim 12, wherein said leading portion of said second blanket is overlapped atop said trailing portion of said first blanket.

20. A method of compressing and winding a plurality of similarly sized fibrous blankets into a single roll, the method comprising the steps of:

delivering a plurality of fibrous blankets to a staging area adjacent a winder feed chute having a stationary relatively smooth upper compression surface and a stationary relatively smooth lower compression surface in spaced relation to one another, said upper compression surface and said lower compression surface defining a feed chute compression zone;

allowing a leading portion of a first blanket of said plurality of fibrous blankets to pass from said staging area, through said winder feed chute, and engage a compressing winder assembly located downstream of said winder feed chute;

wherein when said first blanket engages said compressing winder assembly, said compressing winder assembly begins to wind said first blanket and thereby pulls a trailing portion of said first blanket downstream;

overlapping a leading portion of a second blanket of said plurality of fibrous blankets with said trailing portion of said first blanket prior to said trailing portion of said first blanket entering said winder feed chute compression zone;

allowing said leading portion of said second blanket to be pulled through said winder feed chute by said first blanket and engage said compressing winder assembly;

wherein when said second blanket engages said compressing winder assembly, said compressing winder assembly begins to wind said second blanket and thereby pulls a trailing portion of said second blanket downstream;

overlapping a leading portion of a third blanket of said plurality of fibrous blankets with a trailing portion of said second blanket prior to said trailing portion of said second blanket entering said winder feed chute compression zone;

wherein when said third blanket engages said compressing winder assembly, said compressing winder assembly begins to wind said third blanket and thereby pulls a trailing portion of said third blanket downstream.

* * * * *